US011021849B2

(12) United States Patent
Qian

(10) Patent No.: US 11,021,849 B2
(45) Date of Patent: Jun. 1, 2021

(54) CIVIL ENGINEERING ANTI-SEISMIC STRUCTURE

(71) Applicant: Shenszhen Yaolan Technology Co., Ltd., Shenzhen (CN)

(72) Inventor: Siyu Qian, Suzhou (CN)

(73) Assignee: Shenzhen Yaolan Technology Co., Ltd., Shenzhen (CN)

( * ) Notice: Subject to any disclaimer, the term of this patent is extended or adjusted under 35 U.S.C. 154(b) by 0 days.

(21) Appl. No.: 16/977,109

(22) PCT Filed: Dec. 12, 2018

(86) PCT No.: PCT/CN2018/120723
§ 371 (c)(1),
(2) Date: Sep. 1, 2020

(87) PCT Pub. No.: WO2020/118577
PCT Pub. Date: Jun. 18, 2020

(65) Prior Publication Data

US 2021/0002846 A1 Jan. 7, 2021

(30) Foreign Application Priority Data

Dec. 11, 2018 (CN) ..... 201822075659.X

(51) Int. Cl.
*E02D 31/00* (2006.01)
*E02D 31/08* (2006.01)
*E02D 27/34* (2006.01)

(52) U.S. Cl.
CPC ..... *E02D 31/08* (2013.01); *E02D 27/34* (2013.01); *E02D 2200/146* (2013.01)

(58) Field of Classification Search
CPC ... E02D 31/08; E02D 27/34; E02D 2200/146; E04B 1/98; E04H 9/00; E04H 9/02;
(Continued)

(56) References Cited

U.S. PATENT DOCUMENTS 2,055,000 A * 9/1936 Bacigalupo ..... E04H 9/023 52/167.6
4,328,648 A * 5/1982 Kalpins ..... E02D 27/34 52/167.4

(Continued)

FOREIGN PATENT DOCUMENTS

CN 107313424 A 11/2017

OTHER PUBLICATIONS

International Search Report issued in corresponding International application No. PCT/CN2018/120723, dated Sep. 9, 2019.

(Continued)

*Primary Examiner* — Edwin J Toledo-Duran

(57) ABSTRACT

A civil engineering anti-seismic structure includes a base. A fixing structure is fixedly welded at the bottom center of the base. A through-hole is provided at the top center of the base. Sliding grooves are provided on corresponding inner walls at two sides of the base. Sliding blocks are slidably connected to the sliding grooves inside the grooves and are symmetrically installed at two sides of a sliding plate. A top block is fixedly welded at the top center of the sliding plate (8), and a fixing groove is provided at the top center of the top block. A shock-absorbing damping pad is fixedly adhered to a bottom inner wall of the base. A first limiting plate is fixedly welded around the top portion of the sliding plate, and a second limiting plate is fixedly welded around the through-hole at a top inner wall of the base.

3 Claims, 2 Drawing Sheets

(58) Field of Classification Search
CPC ..... E04H 9/021; E04H 9/0215; E04H 9/022; E04H 9/023; E04H 9/0235; E04H 9/0237; E04H 9/024; E04H 9/025; E04H 9/027; E04H 9/028; E04H 9/029
USPC ..... 52/167; 16/52, 51; 293/107; 188/322.22, 311.11
See application file for complete search history.

(56) References Cited

U.S. PATENT DOCUMENTS

| | | | | | |
|---|---|---|---|---|---|
| 4,402,483 | A * | 9/1983 | Kurabayashi | E04H 9/021 | 248/636 |
| 4,514,941 | A * | 5/1985 | Gonzalez Flores | E02D 27/34 | 14/73.5 |
| 4,533,109 | A * | 8/1985 | Delam | E01D 19/04 | 188/381 |
| 4,554,767 | A * | 11/1985 | Ikonomou | E04H 9/021 | 52/167.9 |
| 4,599,834 | A * | 7/1986 | Fujimoto | E02D 27/34 | 376/285 |
| 4,917,211 | A * | 4/1990 | Yamada | E04H 9/023 | 181/0.5 |
| 5,014,474 | A * | 5/1991 | Fyfe | E02D 31/08 | 14/73.5 |
| 2013/0089379 | A1 * | 4/2013 | Younan | E02D 29/06 | 405/211 |

OTHER PUBLICATIONS

Written Opinion of the International Searching Authority for No. PCT/CN2018/120723, dated Sep. 9, 2019.
Initial Publication For PCT/CN2018/120723.

* cited by examiner

CIVIL ENGINEERING ANTI-SEISMIC STRUCTURE

BACKGROUND

1. Technical Field

The present disclosure generally relates to a building technology field, and especially relates to a civil engineering anti-seismic structure.

2. Description of Related Art

In the field of buildings, a conventional building is built by a solid combination of a foundation and house columns. This kind of building structure is suitable for areas where the earth's crust is relatively stable, so that the building can stand firmly on the ground. However, if this kind of building structure is built in an area with frequent crustal motion, it will swing due to inertial crustal motion and eventually be shaken down or broken. Therefore, it is necessary to design a civil engineering anti-seismic structure.

SUMMARY

The technical problems to be solved: in view of the shortcomings of the related art, the present disclosure provides to a civil engineering anti-seismic structure which can effective solve the problem that the conventional building foundation and the house column integrated with each other with a rigid connection therebetween so that it is easily to be damaged under earthquake influence.

The technical solution adopted for solving technical problems of the present disclosure is:

a civil engineering anti-seismic structure of the present disclosure includes: a base, a fixing structure welded and fixed at a bottom center of the base, a through-hole formed on a top center of the base, a sliding groove arranged on corresponding inner walls at two sides of the base, a sliding block slidably connected inside the sliding groove and symmetrically installed on both sides of a sliding plate, a top block fixedly welded at a top center of the sliding plate, a fixing groove formed on a top center of the top block, a shock-absorbing damping pad fixedly adhered to a bottom inner wall of the base, a first limiting plate fixedly welded around the top of the sliding plate, a second limiting plate fixedly welded around a top inner wall of the base around the through-hole; and wherein a damping structure is equidistantly welded and fixed between the first limiting plate and the second limiting plate.

Preferably, the fixing structure includes a positioning post fixedly welded at the bottom center of the base, and a plurality of positioning plates equidistantly welded and fixed on the positioning post, and diameters of the plurality of positioning plates on the positioning post distributed in an arithmetic sequence from top to bottom.

Preferably, the positioning plate includes a projection irregularly arranged thereon.

Preferably, the damping structure includes a casing equidistantly welded and fixed to the top of the first limiting plate, a first supporting spring, a limiting block slidably connected inside the casing, a telescopic tube passing through the casing and fixedly welded at the top center of the limiting block, and a second supporting spring sleeved around the telescopic tube and positioned b e casing and the second limiting plate, the first supporting spring installed between the bottom of the limiting block and a bottom inner wall of the casing.

Preferably, a scaling bar is embedded in a side center of the top block.

The present disclosure provides the advantages as below.

The present disclosure can provide a flexible connection between the base and house columns to absorb shock waves and protect the building when the earthquake comes, and have advantages of a novel structure, an ingenious conception and a convenient usage.

BRIEF DESCRIPTION OF THE DRAWINGS

In order to more clearly understand the present disclosure, attached drawings described below are a part of the present disclosure specification to interpret the present disclosure together with embodiments of the present disclosure, which will not constitute limitations of the present disclosure. In the accompanying drawings.

The element labels according to the embodiment of the present disclosure shown as below:

1 base, 10*a* bottom center of the base, 10*b* top center of the base, 1*a* bottom inner wall of the base, 1*b* inner walls on two sides of the base, 1*c* top inner wall of the base, fixing structure 2, top block 3, 3*a* top center of the top block, 4 fixing groove, 5 scaling bar, 6 through-hole, 7 sliding groove, 8 sliding plate, 8*a* top center of the sliding plate, 8*b* top of the sliding plate, 9 shock-absorbing damping pad, 10 sliding block, 11 damping structure, 12 second limiting plate, 13 first limiting plate, 14 positioning plate, 15 positioning post, 16 casing, 16*a* bottom inner wall of the casing, 17 first supporting spring, 18 limiting block, 18*a* top center of the limiting block, 18*b* bottom of the limiting block, 19 telescopic tube, 20 second supporting swing.

DETAILED DESCRIPTION

Reference will now be made in detail to embodiments, examples of which are illustrated in the accompanying drawings 1-4.

Figure 1:
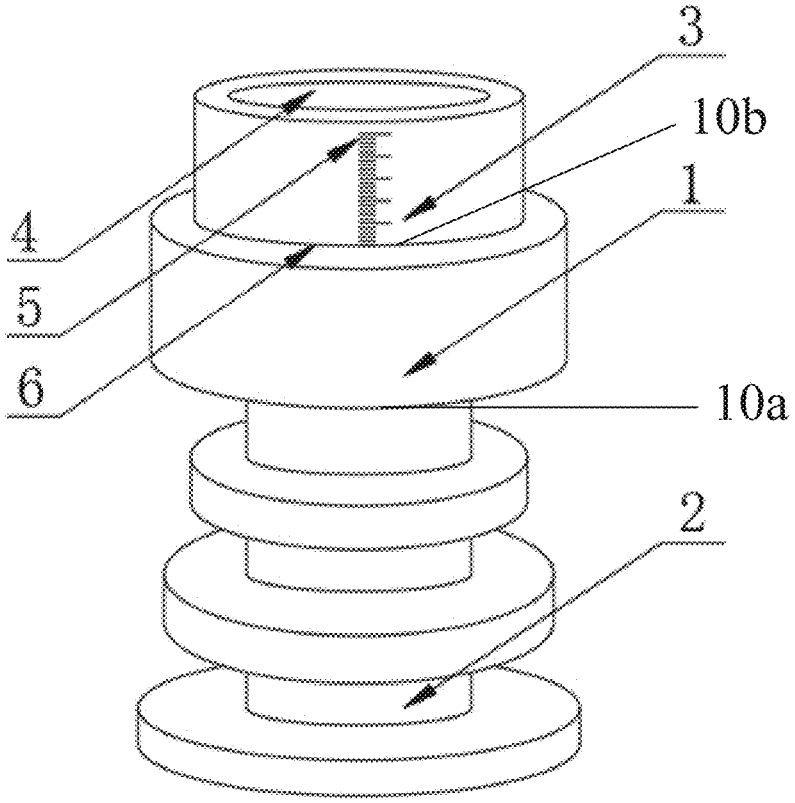
FIG. 1 is a schematic three-dimensional view of a civil engineering anti-seismic structure of the present disclosure.
Figure 2:
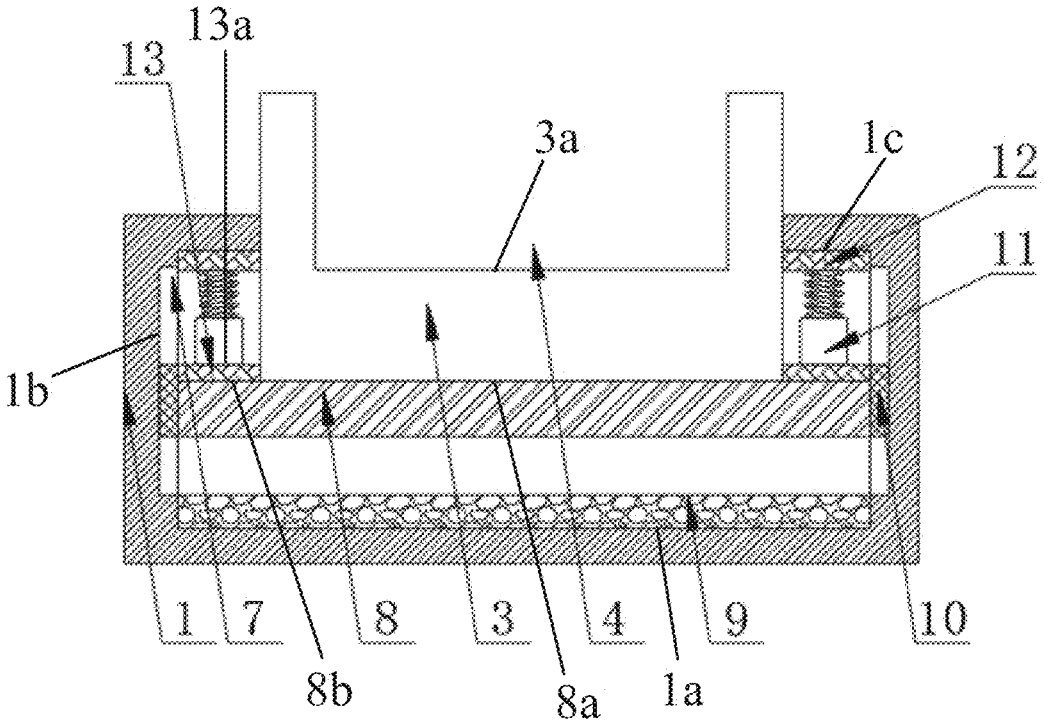
FIG. 2 is a cross section view of the civil engineering anti-seismic structure of the present disclosure.

Referring to FIG. 1 and FIG. 2, a civil engineering anti-seismic structure according to a first embodiment of the present disclosure includes a base 1, a fixing structure 2 fixedly welded at a bottom center 10*a* of the base 1, a through-hole 6 formed on a top center 10*b* of the base 1, a sliding groove 7 arranged on corresponding inner walls 1*b* at two sides of the base 1, a sliding block 10 slidably connected inside the sliding groove 7 and symmetrically installed on both sides of a sliding plate 8, a top block 3 fixedly welded at a top center 8*a* of the sliding plate 8, a fixing groove 4 formed on a top center 3*a* of the top block 3, a shock-absorbing damping pad 9 fixedly adhered to a bottom inner wall 1*a* of the base 1, a first limiting plate 13 fixedly welded around the top 8*b* of the sliding plate 8, a second limiting plate 12 fixedly welded around a top inner wall 1*c* of the base 1 around the through-hole 6. A damping structure 11 is equidistantly welded and fixed between the first limiting plate 13 and the second limiting plate 12. After the base 1 is fixed below the ground by the fixing structure 2, bottom ends of house columns are inserted and fixed to the interior of the fixing groove 4, and top ends of the house columns are fixed on house beams so that the house columns can directly squeeze the shock-absorbing damping pad 9. In this way, a flexible connection between the base 1 and the house columns can be obtained to absorb shock waves and protect the building when the earthquake comes. When the sliding plate 8 is sliding downwardly, the damping structure 11 is stretched, under a counteracting force, the connection between the house columns and the house beams can be ensured more closely, thus ensuring the fixed stability effectively therebetween. Furthermore, both the sliding groove 7 and the sliding block 10 are provided to ensure the sliding plate 8 move stably.

Figure 3:
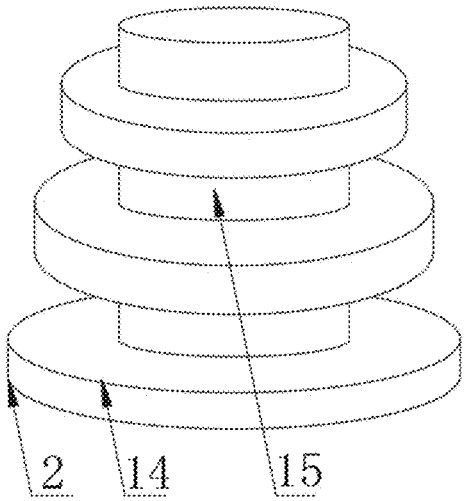
FIG. 3 is a schematic three-dimensional view of a fixing structure of the civil engineering anti-seismic structure of the present disclosure.

Referring to FIG. 1 and FIG. 3, based on the first embodiment of the present disclosure, a second embodiment of the present disclosure is provided that the damping structure 11 includes a positioning post 15 fixedly welded at the bottom center 10*a* of the base 1 and a plurality of positioning plates 14 equidistantly welded and fixed on the positioning post 15, and diameters of the plurality of positioning plates 14 on the positioning post 15 distributed in an arithmetic sequence from top to bottom. The positioning post 15 can effectively and stably fixed by setting the positioning plate 14 when the positioning post 15 is inserted into the ground.

Based on the second embodiment of the present disclosure, a third second embodiment of the present disclosure is provided that the positioning plate 14 includes a projection irregularly arranged thereon.

Figure 4:
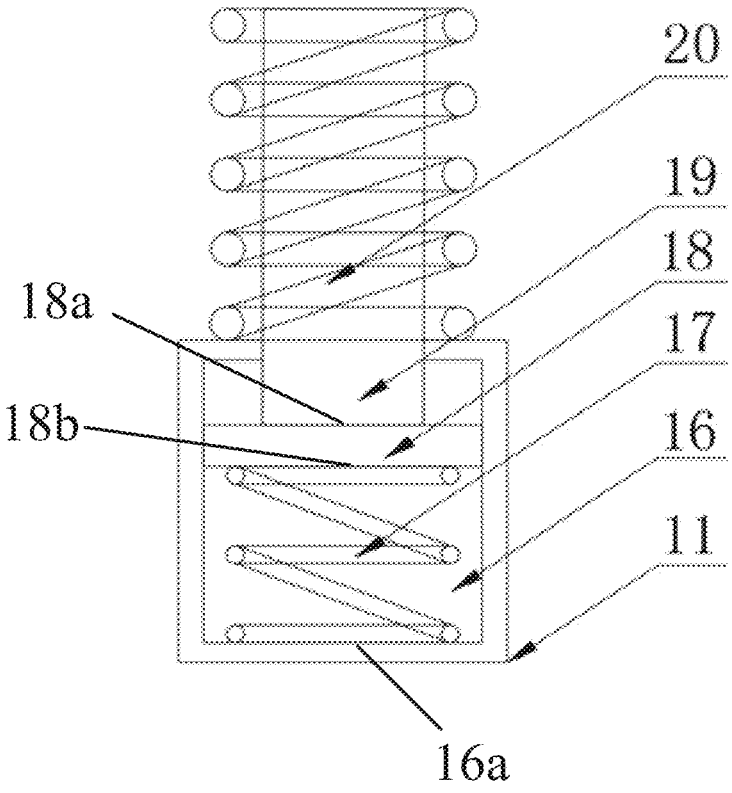
FIG. 4 is a schematic view of a damping structure of the civil engineering anti-seismic structure of the present disclosure.

Referring to FIG. 2 and FIG. 4, based on the first embodiment of the present disclosure, a fourth second embodiment of the present disclosure is provided that the damping structure 11 includes a casing 16 equidistantly welded and fixed to the top of the first limiting plate 13, a first supporting spring 17, a limiting block 18 slidably connected inside the casing 16, a telescopic tube 19 passing through the casing 16 and fixedly welded at the top center 18*a* of the limiting block 18, and a second supporting spring 20 sleeved around the telescopic tube 19 and positioned between the casing 16 and the second limiting plate 12, the first supporting spring 17 installed between the bottom 18*b* of the limiting block 18 and a bottom inner wall 16*a* of the casing 16. When the damping structure 11 is stretched, the telescopic tube 19 is pulled out of the casing 16, so that both the first supporting swing 17 and the second supporting spring 20 are stretched. Under a counterforce of the first supporting spring 17 and the second supporting spring 20, the house column can move upwardly, so as to effectively ensure a tight connection between the house column and the house beam.

Referring to FIG. 1, based on the first embodiment of the present disclosure, a fifth embodiment of the present disclosure is provided that a scaling bar 5 is embedded in a side center of the top block 3 so as to conveniently and accurately check a downward depth of the top block 3.

When using the civil engineering anti-seismic structure of the present disclosure, the base 1 is fixed below the ground by the fixing structure 2, bottom ends of house columns are inserted and fixed to the interior of the fixing groove 4, and top ends of the house columns are fixed on house beams so that the house columns can directly squeeze the shock-absorbing damping pad 9. In this way, a flexible connection between the base 1 and the house columns can be obtained to absorb shock waves and protect the building when the earthquake comes. When the sliding plate 8 is sliding downwardly, the damping structure 11 is stretched, under a counterforce, the connection between the house columns and the house beams can be ensured more closely, thus ensuring the fixed stability effectively therebetween. Furthermore, both the sliding groove 7 and the sliding block 10 are provided to ensure the sliding plate 8 move stably.

The present disclosure can provide a flexible connection between the base and the house columns to absorb shock waves and protect the building when the earthquake comes, and have advantages of a novel structure, an ingenious conception and a convenient usage.

Finally, it should be noted that: the above description is only the preferred embodiment of the present disclosure rather than constitute limitations of the present disclosure. Although the features and elements of the present disclosure are described as embodiments in detail, for one of ordinary skill in the related art, each feature or element can be used alone or in other various combinations within the principles of the present disclosure to the full extent indicated by the broad general meaning of the terms in which the appended claims are expressed. Any variation or equivalent replacement or improvement made by one of ordinary skill in the related art without departing from the spirit of the present disclosure shall fall within the protection scope of the present disclosure.

What is claimed is:

1. A civil engineering anti-seismic structure comprising:

a base (1);

a fixing structure (2) fixedly welded at a bottom center (10*a*) of the base (1);

a through-hole (6) formed on a top center (10*b*) of the base (1);

sliding grooves (7) arranged on corresponding inner walls (1*b*) at two sides of the base (1);

sliding blocks (10) slidably connected inside the sliding groove (7) and symmetrically installed on both sides of a sliding plate (8);

a top block (3) fixedly welded at a top center (8*a*) of the sliding plate (8);

a fixing groove (4) formed on a top center (3*a*) of the top block (3);

a shock-absorbing damping pad (9) fixedly adhered to a bottom inner wall (1*a*) of the base (1);

a first limiting plate (13) fixedly welded around the top (8*b*) of the sliding plate (8);

a second limiting plate (12) fixedly welded around a top inner wall (1*c*) of the base (1) around the through-hole (6); and wherein a damping structure (11) is equidistantly welded and fixed between the first limit plate (13) and the second limit plate (12); and wherein the damping structure (11) comprises a casing (16) equidistantly welded and fixed to the top of the first limiting plate (13), a first supporting spring (17), a limiting block (18) slidably connected inside the casing (16), a telescopic tube (19) passing through the casing (16) and fixedly welded at the top center (18*a*) of the limiting block (18), and a second supporting spring (20) sleeved around the telescopic tube (19) and positioned between the casing (16) and the second limiting plate (12), the first supporting spring (17) installed between the bottom (18*b*) of the limiting block (18) and a bottom inner wall (16*a*) of the casing (16); and wherein when using the civil engineering anti-seismic structure, the base (1) is fixed below the ground by the fixing structure (2), bottom ends of house columns are inserted and fixed to the interior of the fixing groove (4), and top ends of the house columns are fixed on house beams so that the house columns can directly squeeze the shock-absorbing damping pad (9) to obtain a flexible connection between the base (1) and the house columns for absorbing shock waves and protect the building when the earthquake comes; while, when the sliding plate (8) is sliding downwardly, the damping structure (11) is stretched, so that under a counterforce, the connection between the house columns and the house beams can be ensured more closely to further ensure fixed stability effectively therebetween.

2. The civil engineering anti-seismic structure as claimed in claim 1, wherein the fixing structure (2) comprises a positioning post (15) fixedly welded at the bottom center (10*a*) of the base (1) and a plurality of positioning plates (14) equidistantly welded and fixed on the positioning post (15), and diameters of the plurality of positioning plates (14) on the positioning post (15) distributed in an arithmetic sequence from top to bottom.

3. The civil engineering anti-seismic structure as claimed in claim 1, wherein a scaling bar (5) is embedded in a side center of the top block (3).

* * * * *